US006814650B2

(12) United States Patent
Bernard et al.

(10) Patent No.: US 6,814,650 B2
(45) Date of Patent: Nov. 9, 2004

(54) TORIC TOOL FOR POLISHING AN OPTICAL SURFACE OF A LENS AND A METHOD OF POLISHING AN ATORIC SURFACE USING THE TOOL

(75) Inventors: Joël Bernard, Ormesson sur Marne (FR); Joël Huguet, Creteil (FR); Christophe Jeannin, Maffliers (FR)

(73) Assignee: Essilor International, Charenton le Pont (FR)

( * ) Notice: Subject to any disclaimer, the term of this patent is extended or adjusted under 35 U.S.C. 154(b) by 118 days.

(21) Appl. No.: 10/119,022

(22) Filed: Apr. 10, 2002

(65) Prior Publication Data

US 2003/0017783 A1 Jan. 23, 2003

(30) Foreign Application Priority Data

Apr. 10, 2001 (FR) ..... 01 04872

(51) Int. Cl.[7] ..... B24B 1/00; B24B 49/00

(52) U.S. Cl. ..... 451/5; 451/42

(58) Field of Search ..... 451/5, 42, 43, 451/44

(56) References Cited

U.S. PATENT DOCUMENTS 4,002,439 A * 1/1977 Volk ..... 451/42
4,010,583 A * 3/1977 Highberg ..... 451/42
4,574,527 A * 3/1986 Craxton ..... 451/5
4,580,882 A * 4/1986 Nuchman et al. ..... 351/161
4,733,502 A * 3/1988 Braun ..... 451/42
5,000,761 A * 3/1991 Mayton et al. ..... 51/295
6,012,965 A * 1/2000 Savoie ..... 451/6
6,074,281 A * 6/2000 Swanson et al. ..... 451/42
6,527,632 B1 * 3/2003 Dooley et al. ..... 451/504

* cited by examiner

*Primary Examiner*—Hadi Shakeri
(74) *Attorney, Agent, or Firm*—Young & Thompson

(57) ABSTRACT

A tool for polishing an optical surface of a lens includes a rigid support including a support surface, a first layer called the buffer made from an elastic material and covering at least part of the support surface, and a second layer called the polisher and covering at least part of the buffer. The buffer has a first surface adhering to the support surface and a second surface opposite the first surface. The polisher has a first surface adhering to the second surface of the buffer and a second surface called the polishing surface opposite the first surface and adapted to polish the optical surface of the lens by rubbing against it. The polishing surface is a toric surface and, to be able to polish an atoric optical surface, the buffer is adapted to be compressed elastically and the polisher is adapted to be deformed to espouse the atoric surface. Applications include polishing atoric optical surfaces.

27 Claims, 6 Drawing Sheets

TORIC TOOL FOR POLISHING AN OPTICAL SURFACE OF A LENS AND A METHOD OF POLISHING AN ATORIC SURFACE USING THE TOOL

BACKGROUND OF THE INVENTION

1. Field of the Invention

The invention relates to polishing optical surfaces.

2. Description of the Prior Art

A lens, for example an ophthalmic lens, has two opposite optical surfaces connected by an edge surface that is generally inscribed in a circular cylinder.

At present a distinction is drawn between four categories of optical surfaces, namely:

spherical surfaces, which are well known in the art, aspherical surfaces, which are derived from spherical surfaces, toric surfaces, and atoric surfaces, which are derived from toric surfaces To facilitate an understanding of the following disclosure, one example of the geometrical construction of a toric surface is described next, with reference to FIG. 1.

A torus T, only a portion of which is shown, is obtained by rotation of a circle of radius R2 about an axis Al in the plane of said circle.

The point on the circle at the greatest distance from the axis A1 traces out a circle of radius R1. The radii R1 and R2 are respectively referred to as the larger radius and the smaller radius of the torus T.

In this representation, R1 is much greater than R2.

The circles of radius R1 and R2 are respectively in a plane P1 perpendicular to the axis Al and a plane P2 containing the axis Al, and the planes P1 and P2 intersect along a straight line A2.

A cylinder with axis A2 and of radius R3 (which here is much less than the radius R2) intersects the torus T along a curve C delimiting a toric surface S, which has two plane symmetries: one with respect to the plane P1, and the other with respect to the plane P2.

The intersection of the toric surface S with the plane P1 is a circular arc of radius R1, referred to as the larger meridian M1 of the toric surface S, and the intersection of the toric surface S with the plane P2 is a circular arc of radius R2, referred to as the smaller meridian M2 of the toric surface S.

The larger meridian M1 has a curvature C1 whose value is equal to the reciprocal of the larger radius R1 and the smaller meridian M2 has a curvature C2 whose value is equal to the reciprocal of the smaller radius R2.

Clearly the curvatures of the meridians M1 and M2, which are referred to as the main meridians, are sufficient for a complete definition of the shape of the toric surface S, which is concave in the direction of the axis Al and convex in the opposite direction.

If the toric surface is that of a lens made from a material having a refractive index n, two dioptric powers D1 and D2 for the surface S are defined, on the basis of the curvatures C1 and C2, by the following equations:

$$D1=(n-1)C1, \text{ and}$$

$$D2=(n-1)C2.$$

In the following disclosure, a given surface is considered to be atoric if there is a toric surface which has an offset at any point relative to said atoric surface whose absolute value is less than a chosen value. Here this value is chosen arbitrarily as 0.2 mm for a diameter of 80 mm, but it can be slightly different without departing from the scope of the invention.

At present, optical surfaces have extremely severe constraints on their accuracy, on the one hand with regard to their shape, for which the tolerances are of the order of one micrometer (1 micrometer=$10^{-6}$ meter), and on the other hand with regard to their roughness, for which the tolerances are of the order of one nanometer (1 nanometer=$10^{-9}$ meter).

After roughing out the atoric surface by appropriate machining, the roughness of the roughed out surface is reduced by a polishing step, possibly preceded by a clear polishing step.

The polishing is delicate because it must reduce the roughness of the surface without deforming it.

An optical surface with circular symmetry, such as a spherical surface, can be polished by means of a tool having a polishing surface with a shape complementary to that of the optical surface, the tool and/or the lens being rotated about the axis of symmetry of the optical surface so that the polishing surface rubs against the optical surface.

On the other hand, polishing other types of optical surface gives rise to more problems.

A distinction is drawn between two categories of clear polishing and polishing tools, namely a first category of tools whose diameter is small compared to that of the lens and a second category of tools whose diameter is close to, or possibly greater than, that of the lens. The two categories of tools give rise to totally different clear polishing and polishing techniques, respectively.

Illustrating the first category, the Japanese document JP-09 396 666 discloses a clear polishing tool for an aspherical convex lens and which comprises:

a basic substrate, an elastic member adhering to the surface of the substrate, and a surface member adhering to the surface of the elastic member.

The curvature of a spherical surface for the basic substrate, the elastic member and the surface member is identical to a spherical surface of which the working surface of an aspherical surface lens is an approximation.

During the clear polishing process, the lens is rotated and the tool is simultaneously pressed against the working surface.

Because the tool is small compared to the lens, it is necessary to provide a complex kinematic system so that the tool is swept over the whole of the working surface. This proves to be a long and complicated process.

Furthermore, given the relative rotation of the tool and the lens, the tool tends to deform the surface of the lens and impart its own spherical shape to it, at least locally, and the tool is therefore difficult to use on toric or atoric surfaces.

The invention aims to propose a polishing tool and a polishing method using that tool to polish an atoric surface quickly and uniformly whilst at the same time conforming to the constraints on accuracy mentioned above.

Machining mineral glass lenses requires the removal of more material than machining organic glass lenses and causes subsurface microcracks to appear, requiring a longer polishing time to eliminate them, which leads to deformations and inaccuracies in the final shape of the surface of the lens.

The invention is therefore preferably applied to organic glass lenses, which do not have the drawbacks of mineral glass lenses previously cited.

SUMMARY OF THE INVENTION

In a first aspect, the present invention proposes a tool for polishing an optical surface of a lens, the tool including:

a rigid support including a support surface, a first layer called the buffer, made from an elastic material, and covering at least part of the support surface and including:

a first surface adhering to the support surface, and a second surface opposite the first surface, a second layer called the polisher, covering at least part of the buffer, and including:

a first surface adhering to the second surface of the buffer, and a second surface called the polishing surface opposite the first surface and adapted to polish the optical surface of the lens by rubbing against it, wherein the polishing surface is a toric surface and has two circular main meridians with respective curvatures C1, C2 such that the curvature C1 is much less than the curvature C2, and, to be able to polish an atoric optical surface, the buffer is adapted to be compressed elastically and the polisher is adapted to be deformed to espouse the atoric surface.

During polishing, the tool and the surface to be polished are moved relative to each other with two movements in two perpendicular directions, each of which follows one of the meridians of the polishing surface.

According to other features of the tool:

the buffer has a uniform thickness $e_T$ normal to its second surface and the polisher has a uniform thickness $e_P$ normal to its polishing surface;

the thickness $e_T$ of the buffer is from 4 mm to 6 mm;

the thickness $e_P$ of the polisher is from 0.5 mm to 1.1 mm.

In a preferred embodiment the support surface is a toric surface and has two main meridians coplanar with the main meridians of the polishing surface, the meridians having respective curvatures CS1, CS2 satisfying the following equations:

$$\frac{1}{CS1} = \frac{1}{C1} - e_T - e_P$$

$$\frac{1}{CS2} = \frac{1}{C2} - e_T - e_P$$

The above specifications enable the tool to be produced as a function of the curvatures C1, C2 to be imparted to the polishing surface and the thicknesses $e_T$ and $e_P$ of the buffer and the polisher.

In accordance with other features, more specifically concerning the production of the buffer:

the buffer is made of a material which is deformed by more than 5% by a pressure of 0.04 MPa;

the buffer is made of elastomeric material or polyurethane foam.

The polisher can be made of woven fabric, felt, or preferably of polyurethane foam.

The tool that has just been described is used to polish an atoric optical surface of a lens such as an ophthalmic lens, preferably a lens made of organic glass.

The lens having a circular edge surface having a given diameter, the tool preferably has a circular section whose diameter is greater than the diameter of the edge surface of the lens.

In another aspect, the invention proposes a method of polishing an atoric optical surface of an ophthalmic lens corresponding to a given prescription, the method including the following steps:

taking into account characteristic geometrical values of the optical surface of the lens, and using a tool as defined above, during use of which tool the polishing surface of the polisher and the optical surface of the lens are in relative bearing and rubbing interengagement.

According to the invention, the above method includes, prior to the step of using the tool, a step of determining the tool, the tool determination step comprising the following sub-steps:

a) determining a toric surface close to the optical surface of the lens, the toric surface, called the best torus, comprising two circular main meridians having respective curvatures C*1, C*2 such that the curvature C*1 is much less than the curvature C*2, b) determining a toric surface corresponding to the given prescription, the toric surface, called the reference torus, comprising two circular main meridians having respective curvatures C'1, C'2 such that the curvature C'1 is much less than the curvature C'2, c) determining respective values of the curvatures C1, C2 of the polishing surface from the following equations:

$$C1 = C^*1 + \Delta C1, \text{ and}$$

$$C2 = C^*2 + \Delta C2,$$

in which:

ΔC1, called the first correction, is a function of:

the curvatures C*1, C*2 of the best torus, the curvatures C'1, C'2 of the reference torus, and the diameter of the edge surface of the lens, and ΔC2, called the second correction, is constant In step c), the first correction ΔC1 is, for example, an affine function of:

the difference C*2−C*1 between the curvatures C*2, C*1 of the best torus, and/or the difference C'2−C'1 between the curvatures C'2, C'1 of the reference torus.

In one embodiment, in step c), the value of the first correction ΔC1, is expressed in $m^{-1}$, is given by the following equation:

$$\Delta C1 = a + b(C'2 - C'1) + c[(C'2 - C'1) - (C^*2 - C^*1)] + d.\Phi 2,$$

where a, b, c, d are parameters of constant value and Φ2 is the diameter of the edge surface of the lens.

The parameters a, b, c, d are defined as follows, for example:

the value of the parameter a is from 0 to 4 $m^{-1}$, preferably from 0.2 $m^{-1}$ to 3.4 $m^{1}$.

the value of the parameter b, with no units, is from 0.01 to 0.3, preferably from 0.05 to 0.25.

the value of the parameter c, also with no units, is from −2 to −0.01, preferably from −1.5 to −0.1.

the value of the parameter d is from −100 $m^{-2}$ to 0, preferably from −60 $m^{-2}$ to −2 $m^{-2}$, the diameter of the edge surface of the lens being expressed in m.

The second correction ΔC2 is, for example, from 0 to 0.8 $m^{-1}$, preferably from 0.1 $m^{-1}$ to 0.64 $m^{-1}$, for example equal to 0.37 $m^{-1}$.

In step a), the determination of the best torus is preferably carried out by the mathematical method known as the least squares method.

In one embodiment, in step a), the determination of the best torus is carried out for only a portion of the atoric surface of the lens, the portion having a circular circumference coaxial with the edge surface of the lens.

In another aspect, the invention proposes a unit for determining the tool for application of a method as just described, including:

a computer including:

means for computing the curvatures C*1, C*2 of the best torus as a function of characteristics of the optical surface of the lens, means for computing the curvatures C'1, C'2 of the reference torus as a function of the prescription, and means for computing curvatures C1, C2 of the polishing surface as a function of the curvatures C*1, C*2, C'1, C'2 and the diameter of the edge surface of the lens, an input device connected to the computer and including means for entering characteristics of the optical surface of the lens, a memory connected to the computer and including:

a first memory area for storing geometrical characteristics of the atoric surface of the lens, a second memory area for storing the curvatures C*1, C*2 of the best torus, a third memory area for storing the curvatures C'1, C'2 of the reference torus, and a fourth memory area for storing the curvatures C1, C2 of the polishing surface, and an output device connected to the computer and including means for displaying at least values input to the computer.

In a further aspect, the invention provides an installation for polishing ophthalmic lenses and suitable for implementing a method as just described, the installation including:

a lens support, a tool-holder, means for creating relative movement of the lens support and the tool-holder, and a digital control unit including a tool determination unit as described above.

The invention can be used to polish an atoric optical surface quickly and efficiently without deforming it. The compressible buffer assures permanent contact between the polisher and the atoric surface of the lens.

Other objects and advantages of the invention will become apparent in the light of the following description, which is given with reference to the accompanying drawings.

DETAILED DESCRIPTION OF THE PREFERRED EMBODIMENT

Figure 1:
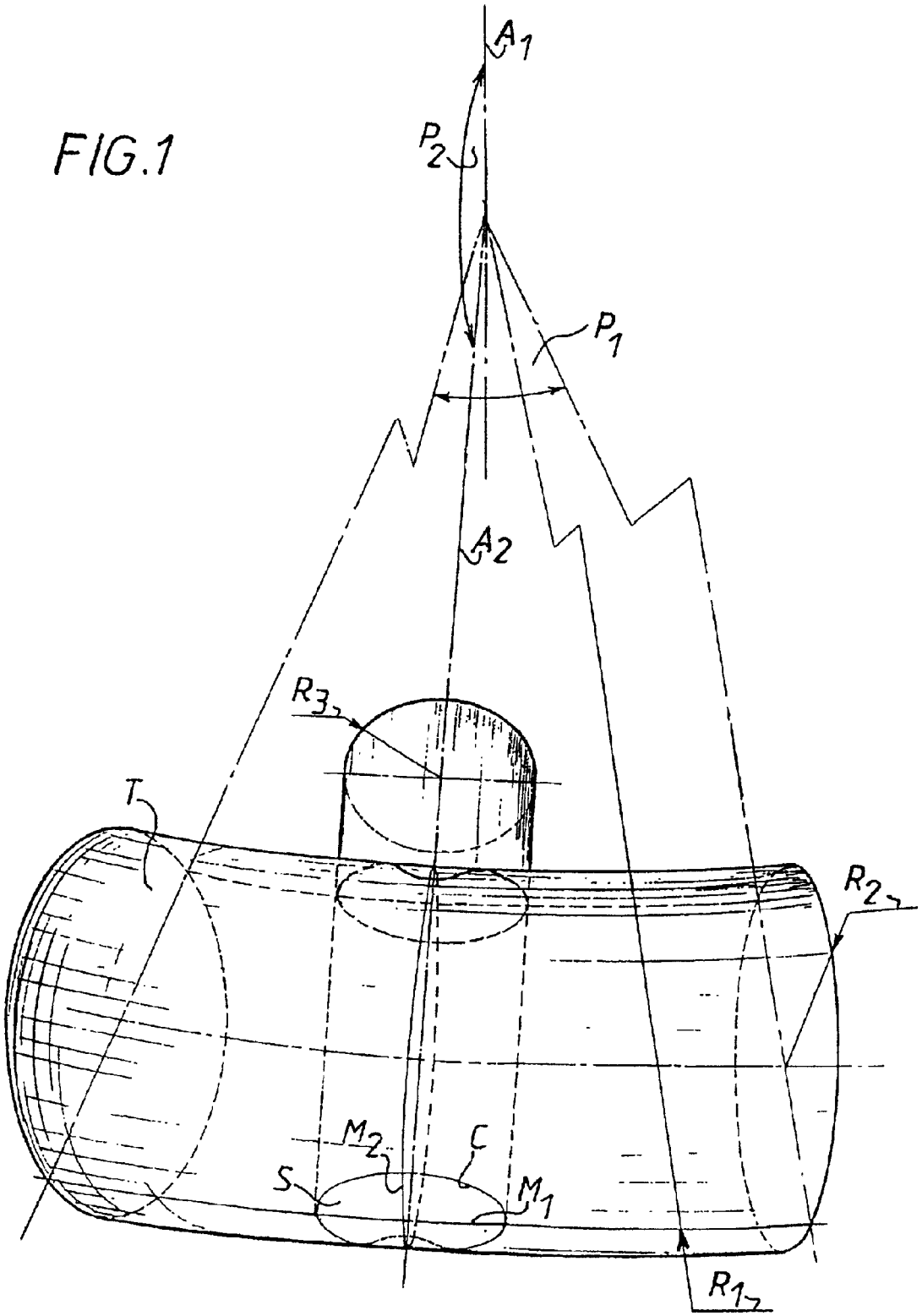
FIG. 1 is a perspective view of a toric surface delimited by a curve which is the intersection of a circular torus, only a portion of which is shown, and a cylinder whose axis is perpendicular to the axis of revolution of the torus, as indicated hereinabove.
Figure 2:
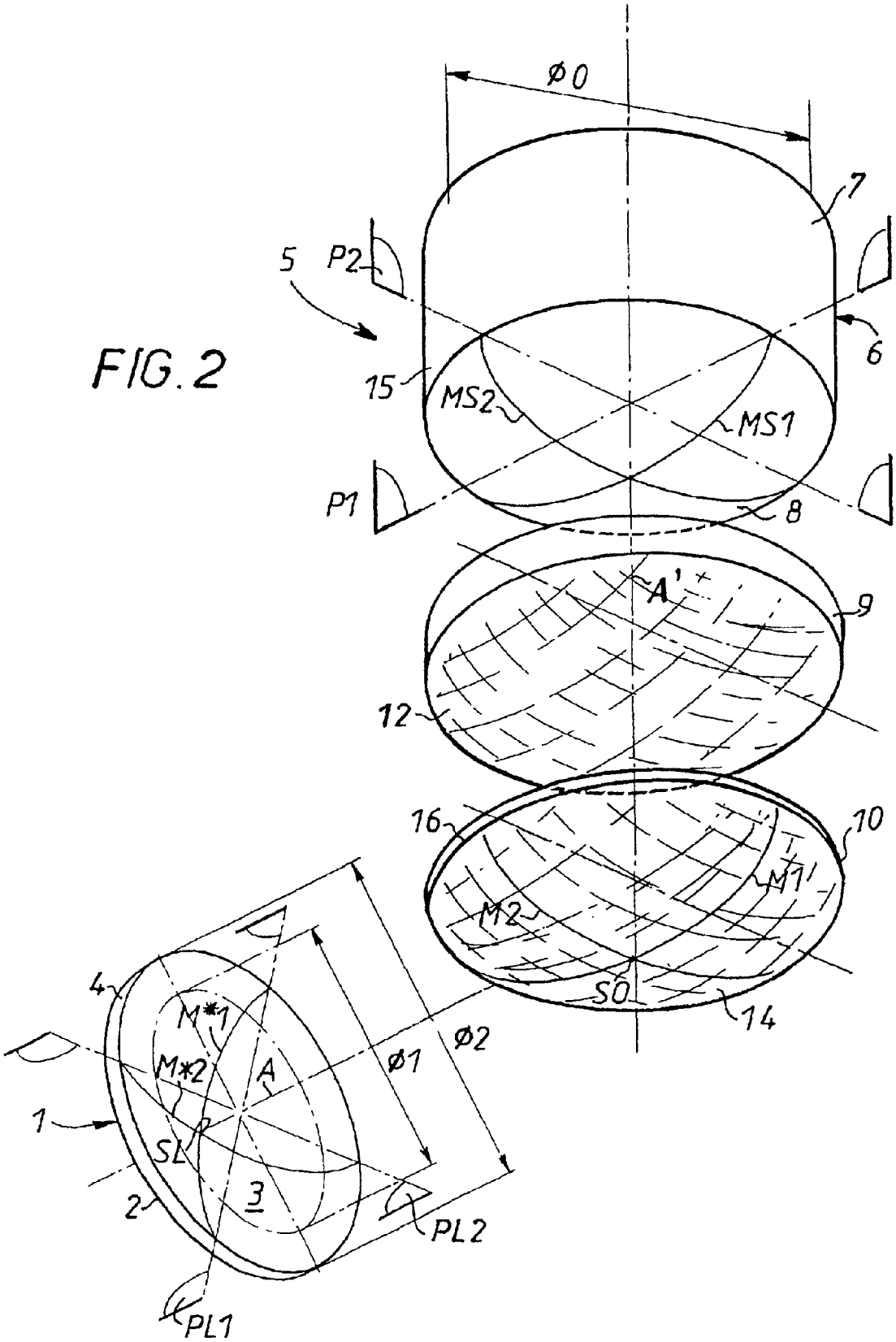
FIG. 2 is a perspective view showing, on the one hand, a lens having an atoric concave optical surface and, on the other hand, a tool, shown in exploded view, for polishing said surface, said tool having a toric polishing surface.

FIG. 2 shows an ophthalmic lens 1 which is preferably made of organic glass and has two optical surfaces, namely a spherical convex surface 2 having an axis A of revolution and an atoric concave surface 3 opposite the convex surface 2, the surfaces 2 and 3 being connected by an edge surface 4 inscribed in a cylinder with axis A and of diameter Φ2, which is referred to as the diameter of the lens 1. Conventionally, the diameter Φ2 is from 60 mm to 80 mm.

The axis A of the lens meets the optical surface 3 at a point SL referred to as the apex of the optical surface 3.

The roughness of the unmachined optical surface 3 has to be reduced to impart an acceptable surface state to the surface, without deforming it.

A polishing tool 5 shown in FIGS. 2 and 5 to 11 is used for this purpose and includes:

a rigid support 6 including a generally circular cylindrical body 7 with an axis A' and terminating at one end in a toric support surface 8, a first layer 9, called the buffer, which at least partly covers the support surface 8, and a second layer 10, called the polisher, which at least partly covers the buffer 9.

The tool 5 is delimited in the radial direction by a cylindrical surface 15 concentric with the axis A' and of diameter Φ0, which is referred to as the diameter of the tool 5.

The buffer 9, which has a uniform thickness $e_T$ in the absence of stress, is made from an elastically compressible material and has a first surface 11 adhering to the support surface 8 and a second surface 12 opposite the first surface 11.

The polisher 10, which has a uniform thickness $e_P$, has a first surface 13 adhering to the second surface 12 of the buffer 9 and a second surface 14 opposite the first surface 13; the second surface 14, called the polishing surface, is adapted to polish the optical surface 3 by rubbing against it.

In one embodiment, the buffer 9, whose thickness $e_T$ is from 4 mm to 6 mm, for example, is made from a material which is compressed by more than 5% by a pressure of 0.04 MPa.

The buffer 9 can be made from an elastomer material or preferably from polyurethane foam.

The polisher 10, whose thickness $e_P$ is from 0.5 mm to 1.1 mm, for example, is made of a woven fabric, felt or, in a preferred embodiment, polyurethane foam.

The polisher 10 is deformable, because of the compressibility of the buffer 9, so that it can espouse the shape of the optical surface 3 of the lens 1.

The buffer 9 and the polisher 10 are successively glued or molded onto the support surface 8, for example, so that the second surfaces 12 and 14 of the buffer 9 and the polisher 10 espouse the shape of the surface of the support 8, ignoring the thickness of the buffer 9 and the polisher 10.

In the absence of any stress, the polishing surface 14 has two plane symmetries: one with respect to a plane P1 containing the axis A', and the other with respect to a plane P2 also containing the axis A' and perpendicular to the plane P1.

The toric polishing surface 14 has two main meridians M1 and M2 respectively defined by the intersection of the polishing surface 14 with the plane of symmetry P1 and with the plane of symmetry P2.

The main meridians M1 and M2, which are circular arcs, intersect on the axis A' at a point SO referred to as the apex of the polishing surface 14.

It is assumed arbitrarily that the meridian M1, which has a curvature C1, is the larger meridian of the polisher surface 14, and that the meridian M2, which has a curvature C2, is its smaller meridian, so that the value of the curvature C1 is much less than the value of the curvature C2.

The choice of the tool 5, i.e. the choice of the polishing surface 14, is a function of the shape of the optical surface 3.

Obviously it is sufficient to determine the curvatures C1, C2 of the main meridians M1, M2 of the polishing surface 14 to define the latter completely and therefore to determine the tool 5.

Because the thicknesses $e_T$ and $e_P$ of the buffer 9 and the polisher 10 are uniform, to fabricate the tool 5 it is obviously necessary to produce a toric support surface 8 that matches the polishing surface 14, ignoring the thicknesses $e_T$ and $e_P$.

Accordingly, the support surface 8 also has two plane symmetries, one with respect to the plane P1 and the other with respect to the plane P2.

The support surface 8 has two main meridians MS1 and MS2, respectively concentric with the meridians M1 and M2 of the polishing surface, and respectively defined by the intersection of the support surface 8 with the plane P1 and the plane P2.

The meridian MS1, which is the larger meridian of the support surface 8, has a curvature CS1 and the meridian MS2, which is the smaller meridian of the support surface 8, has a curvature CS2.

It follows from the foregoing disclosure that the curvatures CS1 and CS2 of the support surface 8 respectively satisfy the following equations:

$$\frac{1}{CS1} = \frac{1}{C1} - e_T - e_P$$

$$\frac{1}{CS2} = \frac{1}{C2} - e_T - e_P$$

The curvatures C1, C2 being predetermined, the thickness $e_T$ and $e_P$ of the buffer 9 and the polisher 10 being chosen, the above equations determine the tool 5.

How the curvatures C1, C2 are determined is described next.

For computation purposes, two toric surfaces are defined beforehand, one called the best torus and the other called the reference torus, which respectively depend directly and indirectly on the optical surface 3 of the lens 1.

These two surfaces, which are operative in determining the curvatures C1 and C2 of the polishing surface, are theoretical surfaces.

The best torus is a toric surface close to the optical surface 3, being determined by the mathematical method known as the least squares method, for example, from a selection of values of geometrical characteristics of the optical surface 3, chosen or measured over a portion only of the lens 1, that portion having a circular circumference of diameter Φ1 coaxial with the edge surface 4 of the lens 1. The diameter Φ1, which is called the computation diameter, is chosen to be equal or substantially equal to 60 mm.

The best torus has two plane symmetries: one with respect to a plane PL1 and the other with respect to a plane PL2 perpendicular to the plane PL1.

The best torus has two main meridians M*1 and M*2, respectively defined by the intersection of the best torus with the first and second planes of symmetry PL1, PL2.

It is assumed arbitrarily that the main meridian M*1, which has a curvature C*1, is the larger meridian of the best torus and that the meridian M*2, which has a curvature C*2, is the smaller meridian of the best torus, so that the value of the curvature C*1 is much less than the value of the curvature C*2.

The reference torus is the toric surface corresponding to the ophthalmic prescription for the optical surface 3 to be produced.

To be more precise, the reference torus is a toric surface such that, if it were to be substituted for the atoric surface 3 of the lens 1, would yield at a chosen point of the latter the same prescription value as a toric surface 3.

Said chosen point is generally the point of preference of the prism (PRP), well known to the person skilled in the art.

The reference torus has two circular main meridians with respective curvatures C'1, C'2.

It is assumed that the main meridian M'1 with curvature C'1 is the larger meridian of the reference torus and that the main meridian with the curvature C'2 is the smaller meridian of the reference torus, so that the value of the curvature C'1 is much less than the value of the curvature C'2.

Figure 4:
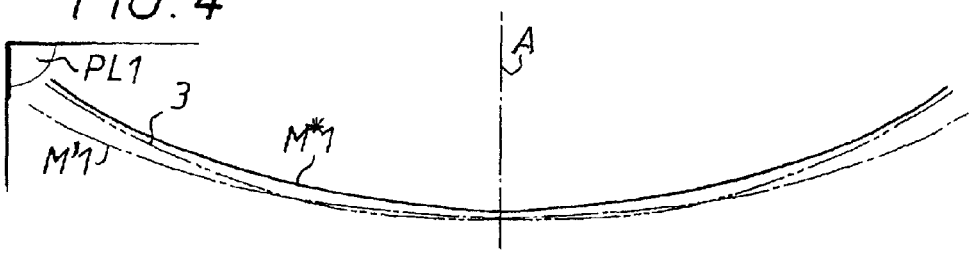
FIG. 4 is a graph on which are superimposed, in a cutting plane, the atoric surface of the lens, the larger main meridian of the corresponding reference torus, and the larger main meridian of the corresponding best torus.
Figure 6:
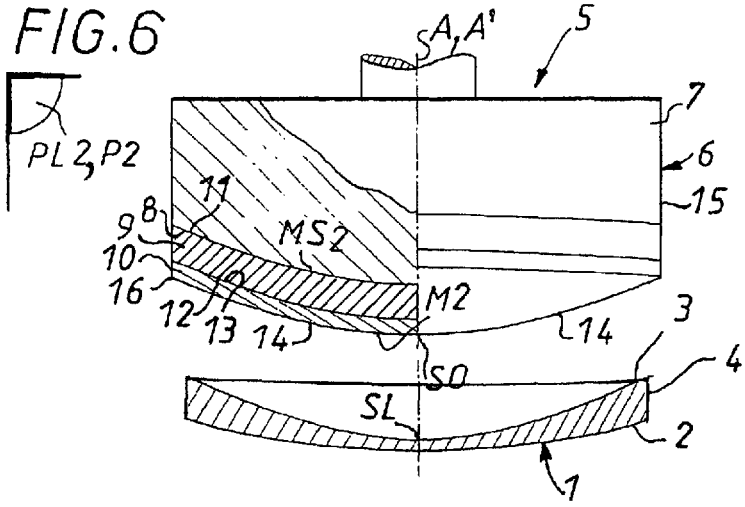
FIG. 6 is an elevation view, partly in section, taken along the line VI—VI in FIG. 5, the cutting plane here being the plane of the smaller main meridian of the polishing surface of the tool.
Figure 5:
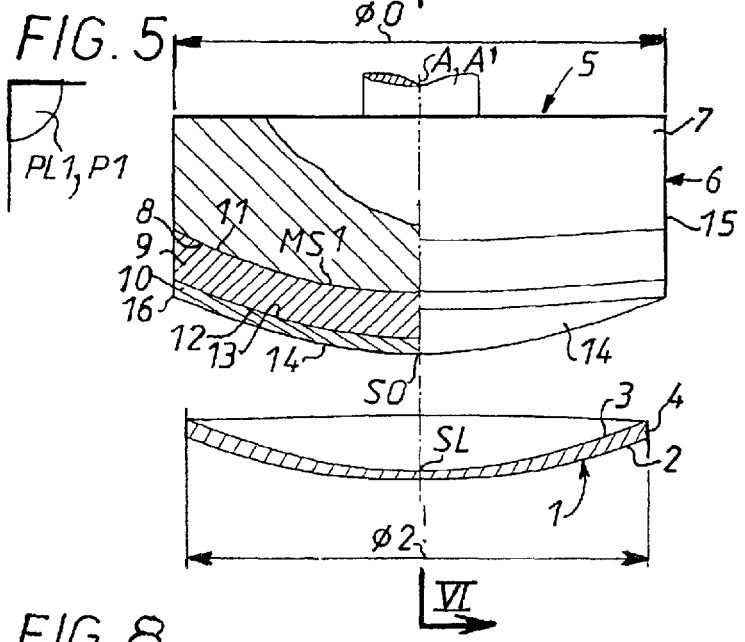
FIG. 5 is an elevation view, partly in section, showing the lens and the polishing tool before polishing, in positions in which they are coaxial, the section plane being the plane of the larger main meridian of the polishing surface of the tool.
Figure 8:
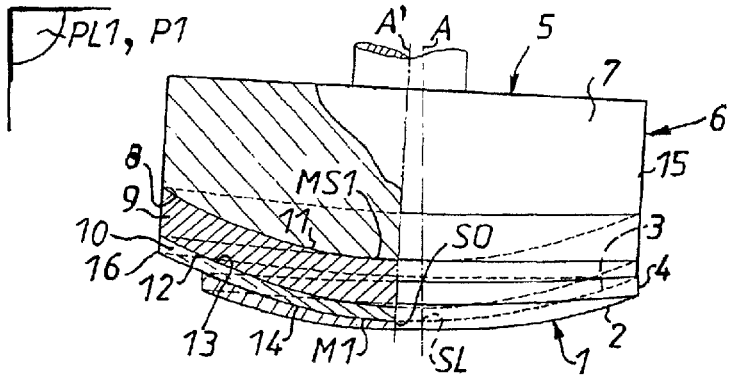
FIG. 8 is an elevation view in half-section of the lens and the tool during polishing of the atoric surface of the lens, the tool being in an off-center position in which the edge of the polishing surface coincides locally with the edge of the lens.

The larger meridians M*1, M'1 of the best torus and the reference torus are shown in FIG. 4, superimposed on the atoric optical surface 3 of the lens 1, in the plane PL1.

When the best torus and the reference torus have been determined, in particular in terms of their respective curvatures C*1, C*2, C'1, C'2, the values of the curvatures C1 and C2 are determined by computing them from the respective equations:

$$C1 = C^*1 + \Delta C1, \text{ and}$$

$$C2 = C^*2 + \Delta C2,$$

in which:

ΔC1 called the first correction, is a function of:

the curvatures C*1, C*2 of the best torus, the curvatures C'1, C'2 of the reference torus, and the diameter Φ2 of the edge surface 4 of the lens 1, ΔC2, called the second correction, is constant.

In particular, the first correction ΔC1 is, for example, an affine function of:

the difference C*2−C*1 between the curvatures C*2, C*1 of the best torus, and/or the difference C'2−C'1 between the curvatures C'2, C'1 of the reference torus.

In one embodiment, the value of the first correction ΔC1, expressed in $m^{-1}$, is given by the following equation:

$$\Delta C1=a+b(C'2-C'1)+c[(C'2-C'1)-(C*2-C*1)]+d.\Phi 2,$$

in which a, b, c, d are parameters of constant value, chosen as follows.

The value of the parameter a, expressed in $m^{-1}$, is from 0 to 4, and preferably from 0.2 to 3.4.

The value of the parameter b, with no units, is from 0.01 to 0.3, and preferably from 0.05 to 0.25.

The value of the parameter c, also with no units, is from −2 to −0.01, and preferably from −1.5 to −0.1.

The value of the parameter d, expressed in $m^{-2}$, with Φ2 expressed in m, is from −100 to 0, and preferably from −60 to −2.

The value of the second correction ΔC2, also expressed in $m^{-1}$, is from 0 to 0.8, and preferably from 0.1 to 0.64, for example. In one embodiment, the value of the second correction ΔC2 is equal or substantially equal to 0.37 $m^{-1}$.

Also, the diameter Φ0 of the tool 5 is chosen to be greater than the diameter Φ2 of the lens 1. The value of the diameter Φ0 of the tool 5 is chosen to be equal or substantially equal to 110 mm, for example.

When it has been determined in the manner just described, the tool 5 is used to polish the atoric optical surface 3.

When the tool 5 is being used, the polishing surface 14 and the optical surface 3 bear on each other and rub on each other.

Prior to using it, the tool 5 is offered up to the optical surface 3 at a distance such that the axis A', the plane of symmetry P1 and the plane of symmetry P2 of the tool 5 respectively coincide with the axis A of the lens 1, the plane of symmetry PL1, and the plane of symmetry PL2.

The tool 5 and the lens 1 are then moved toward each other until the polishing surface 14 comes into contact with the optical surface 3 of the lens 1, without compressing the buffer 9.

Figure 7:
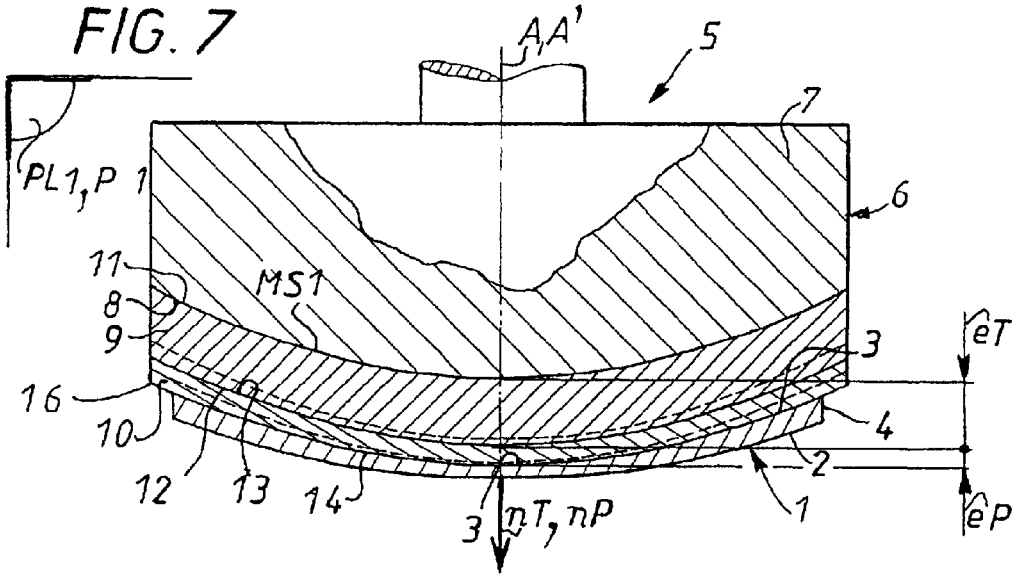
FIG. 7 is a sectional elevation view similar to FIG. 5, showing the tool and the lens in contact to polish the atoric optical surface of the lens.

In this position, shown in chain-dotted line in FIG. 7, the polishing surface 14 is in point contact with the optical surface 3, with their respective apexes SO and SL coinciding.

The tool 5 and the lens 1 are then pressed together other, compressing the buffer 9, until the polishing surface 14 is totally in contact with the optical surface 3. This position is shown in full line in FIG. 7.

The tool 5 and the lens 1 are then moved relative to each other with two separate alternating rotary movements, which can be combined to obtain a "scrambling" effect assuring a good quality of polishing.

The first movement is a plane rotation in the plane P1 of the larger meridian M1 of the polishing surface 14 and about a center coinciding with the center of curvature of the meridian M1.

Figure 9:
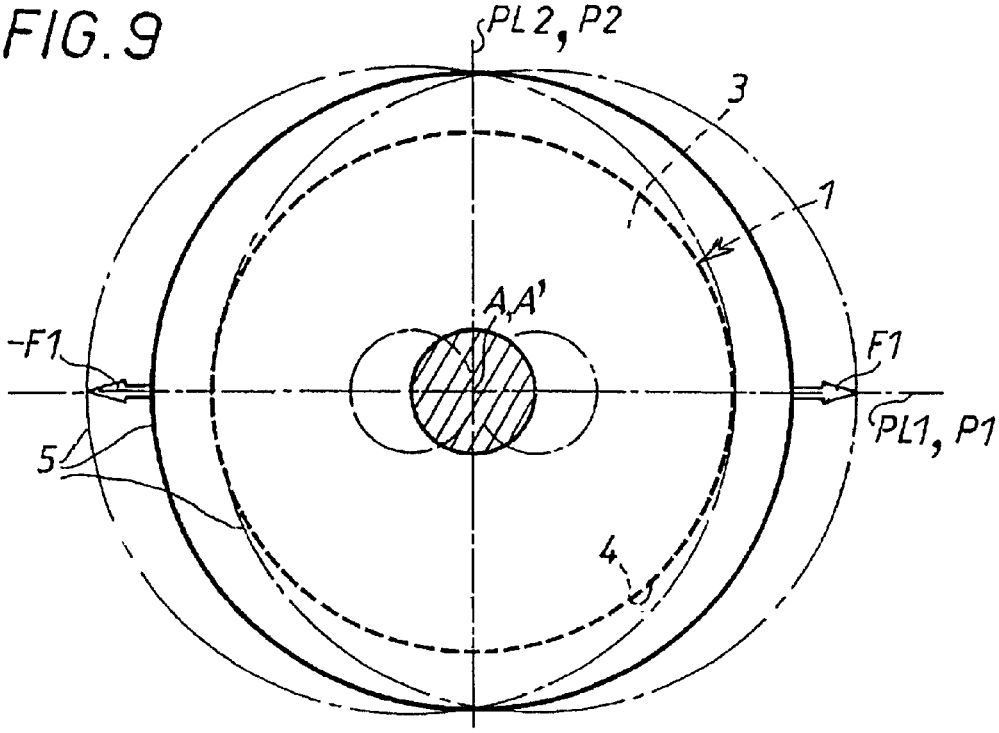
FIG. 9 is a top plan view showing the lens and the tool during polishing of the atoric surface of the lens, with the tool shown in full line in a centered position similar to that of FIG. 7 and in chain-dotted line in an off-center position, similar to that of FIG. 8, in a direction along the larger meridian of the lens or the tool.

The amplitude of this alternating movement, indicated by the arrows F1 and −F1 in FIG. 9, is such that the edge 16 of the polisher 10 locally coincides with the edge surface 4 of the lens 1, the tool 5 then being in an extreme position relative to the lens 1, shown in chain-dotted line in FIG. 9.

The second movement is a plane rotation in the plane P2 of the smaller meridian M2 of the polishing surface 14 and about a center coinciding with the center of curvature of the meridian M2.

Figure 10:
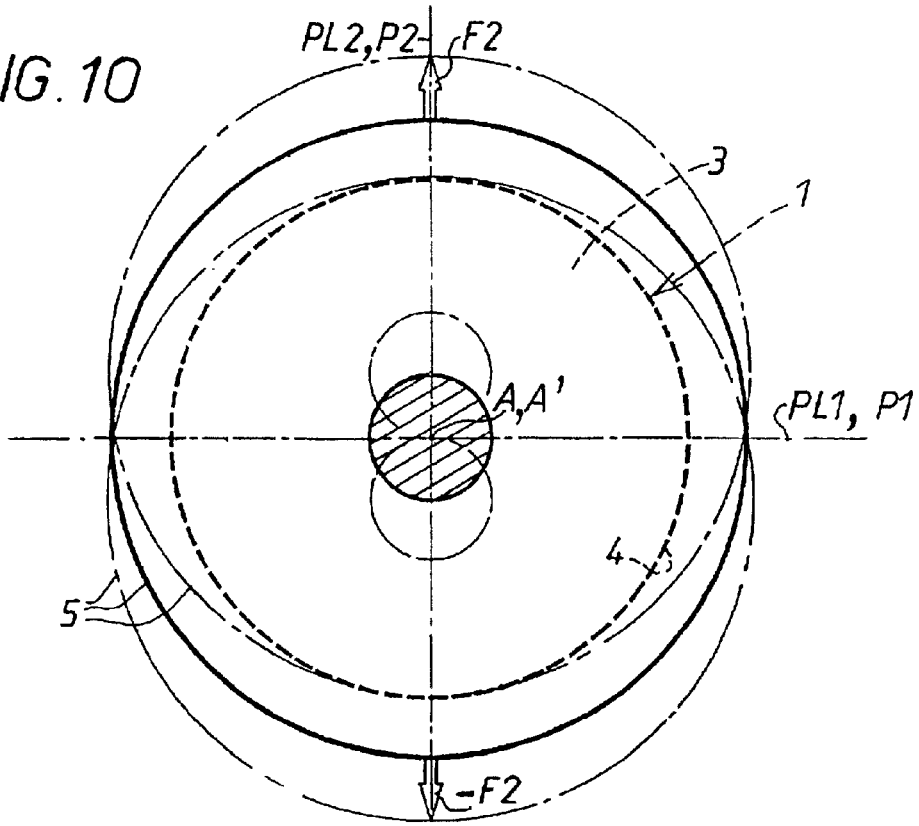
FIG. 10 is a view similar to FIG. 9 with the tool shown in chain-dotted line in an off-center position, similar to that of FIG. 8, in a direction along the smaller meridian of the lens or the tool.

The maximum amplitude of this alternating movement, indicated by the arrows F2 and −F2 in FIG. 10, is such that the edge 16 of the polisher 10 locally coincides with the edge surface 4 of the lens 1, the tool 5 then being in an extreme position relative to the lens 1, shown in chain-dotted line in FIG. 10.

The amplitude can be smaller, so that the lens 1 does not project beyond the tool 5.

In this way, the atoric optical surface 3 is never uncovered during polishing. The chosen diameter Φ0 of the tool 5, which is greater than the diameter Φ2 of the lens 1, enables fast polishing.

Figure 3:
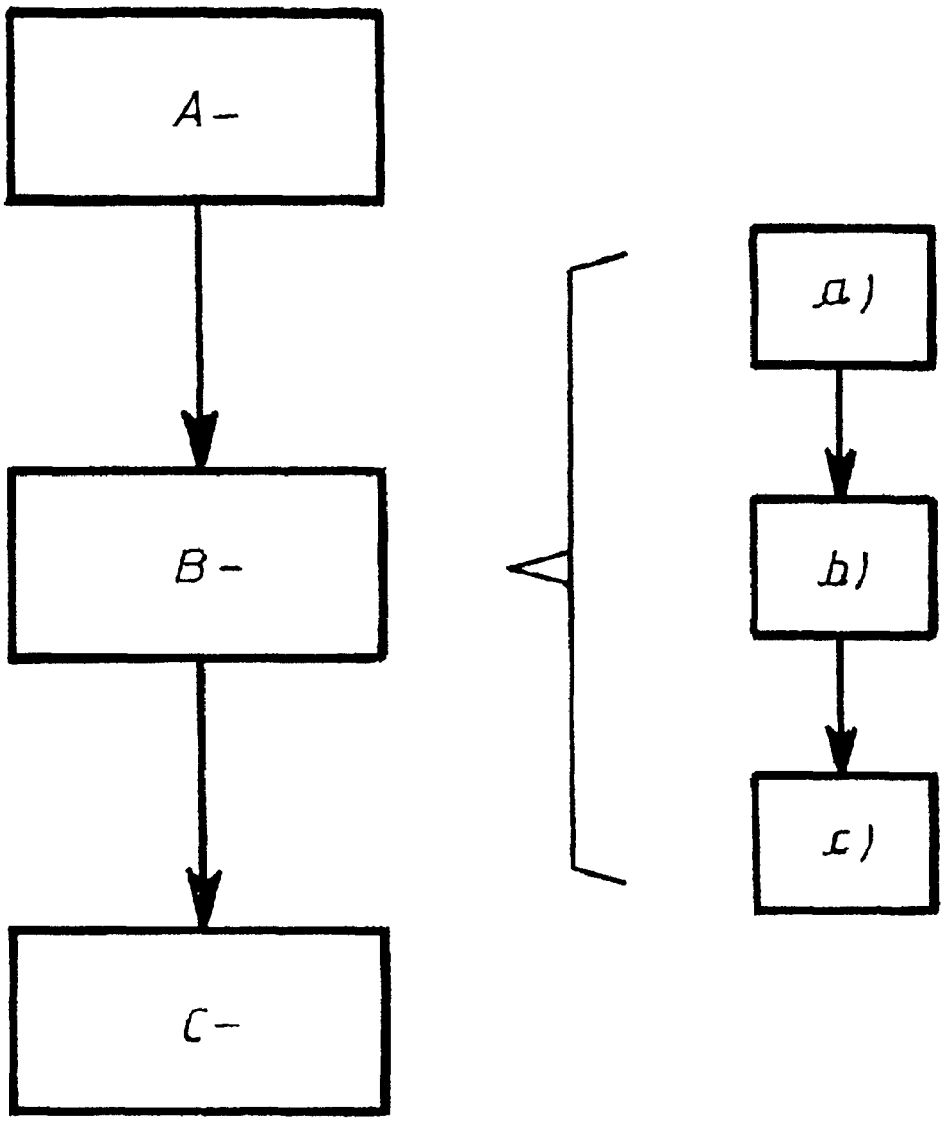
FIG. 3 is a diagram illustrating the various steps of a polishing method according to the invention, the method including a step using a tool like that shown in FIG. 2.

This polishing can be effected by the process shown in the FIG. 3 diagram and which includes the following steps:

A—taking account of characteristic geometric values of the optical surface 3,

B—determining, from said values and the prescription for the optical surface 3, the tool 5 suited to polishing the optical surface 3, this step including the following sub-steps:

a) determining the best torus, as previously described, b) determining the reference torus, as previously described, and c) determining the values of the curvatures C1, C2, as previously described.

C—using the tool determined in step B, in the manner previously described.

The process for determining the tool that has just been described can be implemented automatically by means of a tool determination unit 18, which includes:

a computer 19 including:

means for computing the curvatures C*1, C*2 of the best torus as a function of the values of geometrical characteristics of the optical surface 3 of the lens 1, means for computing the curvatures C'1, C'2 of the reference torus as a function of the prescription, means for calculating the curvatures C1, C2 of the polishing surface 14 as a function of the values of the curvatures C*1, C*2, C'1, C'2 and the diameter Φ2, an input device 20 connected to the computer 19 and including means 21 for entering characteristic values of the optical surface 3, a memory 22 connected to the computer 19 and including:

a first memory area 23 for storing values of geometrical characteristics of the optical surface 3, a second memory area 24 for storing values of the curvatures C*1, C*2 of the best torus, a third memory area 25 for storing values of the curvatures C'1, C'2 of the reference torus, and a fourth memory area 26 for storing values of the curvatures C1, C2 of the support surface 8, and an output device 27 connected to the computer 19 and including means 28 for displaying at least the input values.

The above kind of tool determination unit 18 can be integrated into a digital control unit 29 of a polishing installation 30 for polishing ophthalmic lenses suitable for implementing the method described above.

The installation 30 further includes a lens support 31 to which the lens is temporarily attached during polishing.

The installation 30 further includes a tool-holder 32 on which the tool 5 is mounted, and means 33 connected to the digital control unit 29 for generating relative movement of the lens support 31 and the tool-holder 32, as described above.

Figure 11:
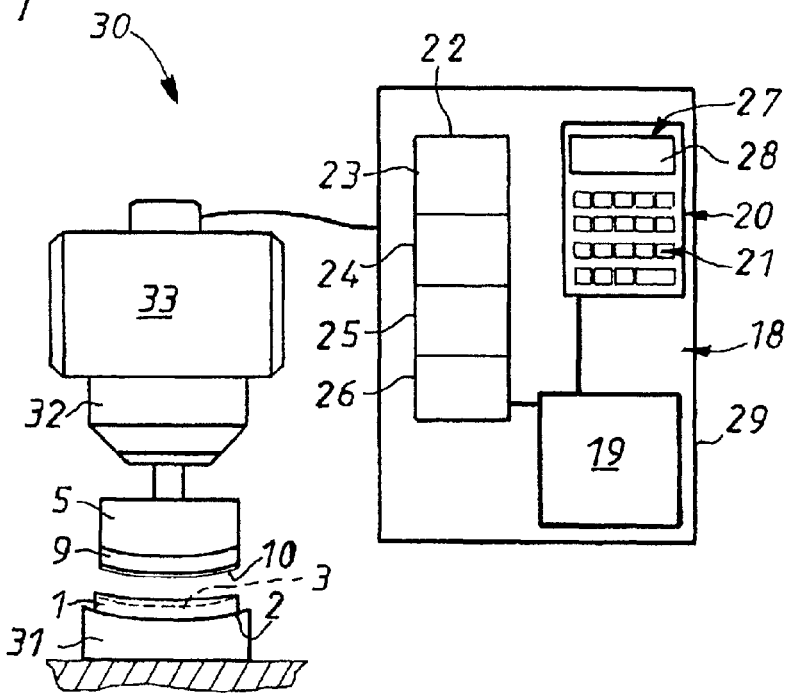
FIG. 11 is a diagram of a polishing installation according to the invention, showing the lens disposed on its support, the tool inserted in the tool-holder and at a distance from the lens, and a digital control unit for the tool-holder.

In the embodiment shown in FIG. 11, the lens support 31 is fixed, in which case only the tool support 32 is moved.

In a different embodiment, the support surface 8 is spherical and the thicknesses $e_T$ and $e_P$ of the buffer 9 and the polisher 10 are chosen to be non-uniform so that, when they are superposed on the support surface 8, a toric polishing surface 14 is obtained whose curvatures C1, C2 conform to the values computed.

Although the description has been given with reference to a concave atoric optical surface of a lens, the invention can obviously be applied to polishing a convex atoric surface. The polishing tool will then be concave, the curvatures of its polishing surface being determined in the manner previously described.

What is claimed is:

1. A tool for polishing an optical surface of a lens, said tool including:

a rigid support including a support surface, a first layer called the buffer made from an elastic material, covering at least part of said support surface, and including:

a first surface adhering to said support surface, and a second surface opposite said first surface, a second layer called the polisher, covering at least part of said buffer, and including:

a first surface adhering to said second surface of said buffer, and a second surface called the polishing surface opposite said first surface and adapted to polish said optical surface of said lens by rubbing against it, wherein said polishing surface is a toric surface and has two circular main meridians with respective curvatures C1, C2 such that the curvature C1 is much less than the curvature C2, and, to be able to polish an atoric optical surface, said buffer is adapted to be compressed elastically and said polisher is adapted to be deformed to espouse said atoric surface, wherein said buffer has a uniform thicknes $e_T$ normal to its second surface and said polisher has a uniform thickness $e_P$ normal to its polishing surface, and wherein said support surface is a toric surface and has two main meridians coplanar with said main meridians of said polishing surface, said meridians having respective curvatures CS1, CS2 satisfying the following equations:

$$\frac{1}{CS1} = \frac{1}{C1} - e_T - e_P$$

$$\frac{1}{CS2} = \frac{1}{C2} - e_T - e_P.$$

2. The tool claimed in claim 1, wherein said thickness $e_T$ of said buffer is from 4 to 6 mm.

3. The tool claimed in claim 1, wherein said thickness $e_P$ of said polisher is from 0.5 mm to 1.1 mm.

4. The polishing tool claimed in claim 1 wherein said buffer is made of a material which is deformed by more than 5% by a pressure of 0.04 MPa.

5. The tool claimed in claim 1 wherein said buffer is made of polyurethane foam.

6. The tool claimed in claim 1 wherein said polisher is made of polyurethane foam.

7. Application of a tool as claimed in claim 1 to polishing an atoric optical surface.

8. The application claimed in claim 7 wherein, said lens having a circular edge surface, said tool has a circular section whose diameter is greater than the diameter of said lens.

9. A method of polishing an atoric optical surface of an ophthalmic lens corresponding to a given prescription and having a circular edge surface, the method comprising the step of polishing the optical surface of the lens with a tool having a rigid support with a support surface, a buffer made from an elastic material and covering at least part of the support surface, a polisher covering at least part of the buffer, the polisher having a polishing surface adapted to polish the optical surface of the lens by rubbing against it, wherein the polishing surface is a first toric surface with two circular main meridians with respective curvatures C1, C2 such that the curvature C1 is much less than the curvature C2, and, wherein the buffer is adapted to be compressed elastically and the polisher is adapted to be deformed to polish an atoric optical surface, during use of which tool the polishing surface of the polisher and the optical surface of the lens are in relative bearing and rubbing interengagement, the method further comprising, prior to said polishing step, a step of determining said tool, said tool determination step comprising the following sub-steps:

a) determining a second toric surface close to said optical surface of said lens, said second toric surface, called the best torus, comprising two circular main meridians having respective curvatures C*1, C*2 such that the curvature C*1 is much less than the curvature C*2, b) determining a third toric surface corresponding to said given prescription, said third toric surface, called the reference torus, comprising two circular main meridians having respective curvatures C'1, C'2 such that the curvature C'1 is much less than the curvature C'2, c) determining respective values of said curvatures C1, C2 of said polishing surface from the following equations:

$$C1 = C^*1 + \Delta C1, \text{ and}$$

$$C2 = C^*2 + \Delta C2,$$

in which:

ΔC1, called the first correction, is a function of:

said curvatures C*1, C*2 of said best torus said curvatures C'1, C'2 of said reference torus, and said diameter of said edge surface of said lens, and ΔC2, called the second correction, is constant.

10. The polishing method claimed in claim 9 wherein, in step c), said first correction ΔC1 is an affine function of the difference C*2−C*1 between the curvatures C*2, C*1 of the best torus.

11. The polishing method claimed in claim 9 wherein, in step c), said first correction ΔC1 is an affine function of the difference C'2−C'1 between said curvatures C'2, C'1 of said reference torus.

12. The polishing method claimed in claim 9 wherein, in step c), the value of said first correction ΔC1 is given by the following equation:

$$\Delta C1=a+b(C'2-C'1)+c[(C2-C'1)-(C^*2-C^*1)]+d.\Phi 2,$$

where a, b, c, d are parameters of constant value and Φ2 is the diameter of said edge surface of said lens.

13. The polishing method claimed in claim 12 wherein the value of said parameter a is from 0 to 4 $m^{-1}$.

14. The polishing method claimed in claim 13 wherein the value of said parameter a is from 0.2 $m^{-1}$ to 3.4 $m^{1}$.

15. The polishing method claimed in claim 12 wherein the value of said parameter b is from 0.01 to 0.3.

16. The polishing method claimed in claim 15 wherein the value of said parameter b is from 0.05 to 0.25.

17. The polishing method claimed in claim 12 wherein the value of said parameter c is from −2 to −0.01.

18. The polishing method claimed in claim 17 wherein the value of said parameter c is from −1.5 to −0.1.

19. The polishing method claimed in claim 12 wherein the value of said parameter d is from −100 $m^2$ to 0.

20. The polishing method claimed in claim 19 wherein the value of said parameter d is from −60 $m^{-2}$ to −2 $m^{-2}$.

21. The polishing method claimed in claim 12 wherein the value of said second correction ΔC2 is from 0 to 0.8 $m^{-1}$.

22. The polishing method claimed in claim 21 wherein the value of said second correction ΔC2 is from 0.1 $m^{-1}$ to 0.64 $m^{-1}$.

23. The polishing method claimed in claim 22 wherein the value of said second correction ΔC2 is equal to 0.37 $m^{-1}$.

24. The polishing method claimed in claim 9 wherein, in step a), said determination of said best torus is carried out by the mathematical method known as the least squares method.

25. The polishing method claimed in claim 9 wherein, in step a), said determination of said best torus is carried out for only a portion of said atoric surface of said lens, said portion having a circular circumference coaxial with said edge surface of said lens.

26. The polishing method of claim 9, wherein the determining step is carried out by computer with:

means for computing said curvatures C*1, C*2 of said best torus as a function of characteristics of said optical surface of said lens, means for computing said curvatures C'1, C'2 of said reference torus as a function of said prescription, and means for computing curvatures C1, C2 of said polishing surface as a function of said curvatures C*1, C*2, C'1, C'2 and said diameter of said edge surface of said lens, an input device connected to said computer and including means for entering characteristics of said optical surface of said lens, a memory connected to said computer and including:

a first memory area for storing geometrical characteristics of said atoric surface of said lens, a second memory area for storing said curvatures C*1, C*2 of said best torus, a third memory area for storing said curvatures C'1, C'2 of said reference torus, and a fourth memory area for storing said curvatures C1, C2 of said polishing surface, and an output device connected to said computer and including means for displaying at least values input to said computer.

27. The polishing method of claim 9, wherein the method is carried out with an installation having:

a lens support, a tool-holder, means for creating relative movement of said lens support and said tool-holder, and a digital control unit including a tool determination unit comprising:

a computer including:

means for computing said curvatures C*1, C*2 of said best torus as a function of characteristics of said optical surface of said lens, means for computing said curvatures C'1, C'2 of said reference torus as a function of said prescription, and means for computing curvatures C1, C2 of said polishing surface as a function of said curvatures C*1, C*2, C'1, C'2 and said diameter of said edge surface of said lens, an input device connected to said computer and including means for entering characteristics of sad optical surface of said lens, a memory connected to said computer and including:

a first memory area for storing geometrical characteristics of said atoric surface of said lens, a second memory area for storing said curvatures C*1, C*2 of said best torus, a third memory area for storing said curvatures C'1, C'2 of said reference torus, and a fourth memory area for storing said curvatures C1, C2 of said polishing surface, and an output device connected to said computer and including means for displaying at least values input to said computer.

* * * * *

UNITED STATES PATENT AND TRADEMARK OFFICE

CERTIFICATE OF CORRECTION

PATENT NO. : 6,814,650 B2
DATED : November 9, 2004
INVENTOR(S) : Joël Bernard et al.

It is certified that error appears in the above-identified patent and that said Letters Patent is hereby corrected as shown below:

Title page,
Item [73], Assignee, change "Essilor International" to -- Essilor International (Compagnie Generale D'Optique) --.

Signed and Sealed this

Nineteenth Day of April, 2005

JON W. DUDAS
*Director of the United States Patent and Trademark Office*